United States Patent [19]

Joyce

[11] 4,298,383

[45] Nov. 3, 1981

[54] LOW VISCOSITY COMPOSITION FOR FORMING SHAPED BODIES

[75] Inventor: John F. Joyce, Granger, Ind.

[73] Assignee: National-Standard Company, Niles, Mich.

[21] Appl. No.: 52,010

[22] Filed: Jun. 25, 1979

[51] Int. Cl.[3] ..... B22F 1/00; B22F 3/00

[52] U.S. Cl. ..... 75/211; 75/200; 75/DIG. 1; 428/252

[58] Field of Search ..... 75/211, 200, DIG. 1; 428/252

[56] References Cited

U.S. PATENT DOCUMENTS

| | | | |
|---|---|---|---|
| 2,842,500 | 7/1958 | Gibson et al. | 264/63 |
| 2,979,401 | 4/1961 | Szymaszek | 75/206 |
| 3,052,532 | 9/1962 | Stoddard et al. | 264/63 |
| 3,567,811 | 3/1971 | Humphrey | 75/206 |
| 3,671,228 | 6/1972 | McIntire et al. | 75/206 |
| 3,672,882 | 6/1972 | Sagmuller et al. | 75/211 |
| 3,705,223 | 12/1972 | Pearson et al. | 75/200 |
| 3,720,511 | 3/1973 | Davies et al. | 75/211 |
| 3,769,044 | 10/1973 | Horton | 106/38.3 |
| 3,796,563 | 3/1974 | Wieland et al. | 75/200 |
| 3,846,527 | 11/1974 | Winter et al. | 264/63 |
| 3,888,662 | 6/1975 | Boeckeler | 75/211 |
| 4,010,233 | 3/1977 | Winter et al. | 264/63 |
| 4,071,594 | 1/1978 | Pearson et al. | 264/63 |
| 4,089,921 | 5/1978 | Dobo | 264/63 |

*Primary Examiner*—Brooks H. Hunt

*Attorney, Agent, or Firm*—Bacon & Thomas

[57] ABSTRACT

A low viscosity composition characterized by pourability comprising a high percentage by weight of particulate inorganic solids. The composition also includes a dispersant, a crosslinking agent, and a binder, with all constituents being dispersed in an aqueous base to define a slurry that may be molded, extruded, cast or otherwise shaped into bodies having a variety of configurations and possessing a high degree of physical integrity and green strength. The particulate inorganic solids may include any metal compounds and mixtures thereof capable of undergoing reduction and sintering to produce high density articles of such metals and alloys thereof.

30 Claims, No Drawings

LOW VISCOSITY COMPOSITION FOR FORMING SHAPED BODIES

BACKGROUND OF THE INVENTION

1. Field of the Invention

The present invention relates generally to the field of technology involving compositions that are useful for producing shaped bodies through a variety of forming techniques. More particularly, the invention is specifically directed to an improved composition of this type wherein metal compounds are utilized to form shaped bodies which may be reduced and sintered to produce metal articles.

2. Description of the Prior Art

The prior art has recognized that metallic shapes such as filaments and fibers may be made by wetting fine particles of metallic compounds with a binding agent, forming a green body from this mixture by molding, extruding or the like, and thereafter reducing the metallic compound to its free metal form and sintering the metal particles to produce a dense metal product. This basic technique has proved quite economical in both operational and material costs due to the fact that expensive and heavy equipment for metal shaping is no longer necessary and waste is minimized since materials can be recycled. Moreover, the final products only require minimum working or finishing treatments.

An example of such known technology is the McIntire et al U.S. Pat. No. 3,671,228 which discloses that high density metallic bodies may be made from reducible metal compounds by forming agglomerates thereof through mixing fine particles of the compounds with a plasticizer or binder. The agglomerates are then compacted into the desired shapes, such as by extrusion to form filamentary articles, and thereafter subjecting the shaped bodies to a reducing environment. The resulting free metal body is then sintered into a very high density metal product. By mixing metallic compounds of different metals in forming the compacted agglomerates, it is possible to produce sintered alloy products for various applications. This patent recognizes that the type of binder or plasticizer utilized to form its agglomerates does affect the green strength of the compacted shapes and surface conditions of the sintered products. However, this technique is primarily concerned with forming an agglomerate that is essentially in the form of a paste mix having a high degree of viscosity so that self-supporting compacted shapes may be made therefrom through extrusion or die-forming.

Another known technique for shaping metallic compound compositions to form free metal articles through subsequent reduction and sintering involves the procedure of slip casting. In this technique, a fine particulate metallic compound that is capable of being reduced to the metallic state is dispersed in a carrier liquid to form a slurry. The viscosity of the slurry is necessarily extremely low so that it may be poured into a mold constructed of a substance that is capable of absorbing the carrier liquid. The mold draws off the carrier liquid, thereby leaving the particulate material deposited on the inner walls of the mold in the desired shape. The formed shape is then subjected to partial or complete drying which causes the shape to shrink a sufficient amount so that it may be easily removed from the mold. This slipcast article, comprising essentially compacted metallic compound particles, is then placed into a reducing environment to convert the compound into free metal. Final sintering of the resulting metallic article produces a dense metal product, with the final density being generally dependent upon the particle size of the precursor metallic compound. Prior art examples of slip casting are disclosed by the Stoddard et al U.S. Pat. No. 3,052,532 and Sagmuller et al U.S. Pat. No. 3,672,882.

In addition to the above described compositions and forming techniques, other similar systems are known in the prior art wherein shaped bodies are formed by mixing particulate metallic and refractory compounds with some form of binder agent so that the resulting agglomerate may be compacted into a desired shape and subjected to heat treatments. Variations of this basic concept have depended primarily upon the type of binder or suspension medium and the specific compacting or forming technique being utilized.

The physical characteristics of a given agglomerate have been found to be directly related to the particle size of the precursor material and the nature of the binding or suspension medium. For certain molding techniques, such as extrusion or ore compaction, it is highly desirable to provide a very viscous agglomerate mix that is substantially self-supporting in nature. Spin casting of the mix into filamentary shapes requires mixes of intermediate viscosities, while slip casting is advantageously conducted with extremely low viscosity or liquid-like agglomerates. As such, known agglomerate mix compositions are basically not versatile in that a given composition possessing specific rheological characteristics is generally restricted to a particular optimum forming technique.

SUMMARY OF THE INVENTION

It is an object of the present invention to provide an improved forming composition which is capable of being compacted or shaped by any of a variety of forming techniques.

It is another object of the invention to provide a forming composition having improved rheological characteristics.

It is yet a further object of the invention to provide an improved forming composition which has a low viscosity characteristic but yet is capable of being shaped into a multitude of different shapes having excellent physical integrity and green strength.

These and other objects of the invention are achieved by providing an improved forming composition which comprises, as its essential constituents, particulate solids, a dispersant, a binder agent, and water. The particulate solids may include any metallic compound which is capable of being reduced to the free metal state and sintered under suitable environmental and heat conditions. Such solids are preferably in fine powdered form and comprise approximately at least 50% by weight of the overall composition. The dispersant comprises up to approximately 1.5% by weight of the total composition and effectively forms a filled viscoelastic composition which has a pourable characteristic due to the low viscosity imparted thereby. The binder comprises up to approximately 15% by weight of the composition and is preferably capable of undergoing crosslinking in order to impart initial physical integrity or green strength to shaped bodies formed therefrom. In this latter regard, a crosslinking agent of up to approximately 15% by weight of the composition may also be included for this purpose.

Further objects of this invention will become apparent to those skilled in the art from the following detailed description thereof when taken in conjunction with the appended claims.

DETAILED DESCRIPTION OF THE PREFERRED EMBODIMENTS

The forming composition according to this invention comprises heretofore unknown advantages and rheological characteristics which are imparted thereto by controlling the nature, type and amount of the constituents which define the basic composition. The composition is particularly characterized by a high solids-to-liquid content ratio while yet maintaining a sufficiently low viscosity in order to permit the mix to flow freely and be poured. Another advantage resides in the use of relatively low binder agent levels while still providing excellent green strength or physical integrity to shaped bodies formed from the composition mix.

The practice of the invention is particularly suited for forming shaped bodies from metallic compounds which are capable of being readily reduced to their respective free metal states. Such metal compounds may include the oxides of Fe, Co, Ni, Cu, Cr, Mn, Mo and W. The insoluble chlorides of Cu, Mo, W and Cr and the sulfides of Cu, Fe, Co, Ni and Mo may also be utilized to advantage in the practice of this invention. Moreover, any other water insoluble metallic compound capable of being reduced and sintered as disclosed by the aforementioned McIntire U.S. Pat. No. 3,671,228 may also be used, the entire disclosure of this patent being herewith incorporated by reference thereto.

The ultimate density of a metal product formed from reducing and sintering an article shaped from the composition of the invention is generally dependent upon the percentage by weight and particle size of the metal compound used. In order to achieve a dense metal product having greater than 90% of theoretical density after reduction and sintering, at least approximately 50% of the metal compound by weight of the total composition is considered the minimum, with about 60 to 85% being the preferred range. The mean particle size of the metal compound particles should not exceed approximately 6 microns, with at least about 25% which do not exceed approximately 2.5 microns. The type of metal compound and morphology are also factors which determine the solids content of the mix.

The more significant metal compounds for the practice of this invention comprise the oxides since these compounds are the most plentiful and exist not only in natural ore concentrates, but are also readily available as by-products of manufacturing. Iron oxides in the form of FeO, $Fe_2O_3$ and $Fe_3O_4$ are particularly useful because they are easily reduced in hydrogen or carbon monoxide atmospheres. Moreover, these specific oxides are relatively pure and inexpensive, as well as being readily obtainable from a variety of sources.

The presence of the dispersing agent in the composition functions to promote the suspension of the fine solid particles of the metal compound in the liquid dispersing medium, such as water. The dispersant essentially wets the surface of each solid particle and forms a connecting link between each particle and the liquid dispersing medium. the molecule becomes attached on the surface of the individual particles, thereby leaving molecular ends exposed which all have the same charge. Since like charges repel, the particles separate and remain apart. Therefore, at any given solids content, such a dispersed system has a lower viscosity than a flocculated system. This is because the absorption of the dispersant on the surface of each particle displaces some of the liquid which results in a very pronounced increase in the fluidity of the composition which, in this case, is essentially a slurry or paste having low viscosity.

By adding a dispersing agent to the composition in an amount of from 0.1 to 1.5% by weight, based on the solids in the dispersant, preferably around 0.5%, very high loading of the composition with solid particles is possible while still maintaining a high degree of fluidity. Though any well known dispersing agent found suitable for the practice of the invention may be utilized, it has been determined that a preferred dispersing agent for achieving high solids mixes is a sodium salt of a polyelectrolyte, such as Tamol 850 manufactured by the Rohm and Haas Company and Nuosperse 700 manufactured by Tenneco Chemicals, Inc. Other similar dispersants may also be utilized to advantage in the practice of the invention.

The type and amount of binding agent is important from the standpoints of maintaining low viscosity at high solids loading and imparting green strength to the shaped bodies. Moreover, the type of binder serves to affect the rheological characteristics of the composition and comprises an important consideration depending on the specific forming technique utilized.

The acceptable range of binder content is approximately 0.1 to 15% by weight of the overall composition, with the preferred range being approximately 0.5 to 5.0%. Suitable binders have been found to include alginate binders made from seaweed or kelp, carboxymethylcellulose (CMC) and guar gums, such as a guar gum derivative in the form of sodium carboxymethylhydroxypropyl cellulose (CMHP) manufactured by the Stein-Hall Company. The use of modified guar gums or guar gum derivatives has been discovered to impart an extensible or stretchable characteristic to the composition, thereby rendering the latter suitable for forming filamentary bodies by withdrawing a continuous filament from a supply of the mix.

Another aspect of binders deemed suitable for use in the practice of the invention is that such binders be preferably capable of undergoing crosslinking so that physical integrity or green strength can be imparted to the shaped body. This provides the unique advantage of being able to employ the composition in not only a multitude of forming techniques, but also permits the forming of the composition into almost any desired shape, such as fine fibers, long strands and sheets. The actual crosslinking can be initially achieved by including a crosslinking agent, such as ammonium borate in an amount of about 0.5% by weight of the initial mix.

As indicated, the novel composition of this invention is suitable for use in making shaped bodies having almost any desired configuration through the implementation of almost any well known forming technique. The composition has been found to be particularly useful in the practice of the method for making high-density sintered metal bodies as disclosed by the McIntire et al U.S. Pat. No. 3,671,228 wherein a compacted agglomerate is reduced in a suitable gaseous environment and thereafter sintered to increase the density of the compact. Through this technique, not only can dense metal articles of a single metal be made, but alloys of plural metals can also be formed by mixing selected precursor metallic compounds of the desired alloy elements.

Suitable forming techniques for shaping bodies from the low viscosity mix of this invention may include doctor blading the mix into mold cavities or depressions provided in a moving belt or other similar mold form, extruding the mix through dies, spin casting the mix to form fibers and similar filamentary shapes, stretching the mix into filamentary shapes, spraying the mix into solid or hollow droplets, platelets or fibers, forming the mix into flat sheets or continuous strips, die cutting discrete sections of mix from a flat sheet, and other such known techniques.

When the mix is shaped according to certain techniques, such as extruding and stretching, the shaped product may be subjected to drying under ambient or heat conditions so that green strength can be immediately imparted to the product for subsequent handling. This is especially important in the forming of filamentary articles, such as strands, mats or strips, which must be gathered or coiled for subsequent reduction and sintering.

It has also been discovered that unusual green strength can be imparted to bodies shaped from the composition by directly passing the shaped body into a solution that is capable of effecting significant crosslinking or gelling of the binder agent. This serves to harden the product and provides a rubbery or elastic consistency thereto. Such crosslinking solutions may include those containing a polyvalent metal ion such as iron, calcium, manganese, nickel or zinc. These include solutions of ferric and ferrous chloride ($FeCl_2$ and $FeCl_3$), nickel chloride ($NiCl_2$) and zinc acetate [$Zn(CH_3COO)_2$]. It was found that when a continuous shaped body, such as a strand, was extruded directly into and submerged within a crosslinking solution, the surface of the body was hardened instantly through crosslinking of the binder, thereby preventing loss of the metallic compound to the solution. The remaining portions of the body were progressively hardened as ions from the solutions diffused throughout the strand.

EXAMPLE 1

As an example of the composition mix of the invention, a slurry was prepared in a Waring blender and comprised the following formulation: 200 grams reagent grade oxide ($Fe_2O_3$), 85 ml. distilled water, 6 ml. Tamol 850, and 2 grams Kelco-Gel LV (Sodium alginate manufactured by the Kelco Company of Chicago, Ill.).

The sodium alginate served as the binder and was first dissolved in the water in the blender. The iron oxide and Tamol 850 were added alternately until all of the formulation was in the blender, with the entire mix comprising approximately 70% solids. The mix was blended for about 15 minutes at half-speed. The resulting slurry product was of relatively low viscosity and easily pourable. The slurry was shaped into sheets which were in turn directed immediately into an iron chloride solution which crosslinked the binder and hardened the shaped sheets. The sheets were then reduced and sintered to form the free metal product. It was found that the degree of ductility of the sintered product depended upon the metal ion used in the crosslinking or hardening solution. Through experimentation, it was determined that the ferrous and ferric ion provided the best ductility, with zinc ion being almost as good. The calcium ion provided significantly reduced ductility and solutions containing manganese ion provided the lowest degree of ductility. It is believed that the ductility effects were caused by variations in the alginate binder after hardening in the various solutions which, in turn, affected the densification of the iron during sintering. Two of the most likely variations would be the amount of dimensional change in the binder when it was hardened and the rigidity of the binder after hardening. If the binder expanded excessively as it hardened, it would reduce the density of the green shape and the subsequent sintered shape. Or, if the binder formed a rigid skeleton that did not shrink as the water was vaporized from the shape, it may serve to prevent the normal densification.

The following example provides indication of the effect of different crosslinking solutions on the ductility of sintered wire produced from the composition mix of the invention.

EXAMPLE 2

A slurry was prepared with the following formulation: 100 grams reagent grade oxide ($Fe_2O_3$), 33.2 ml. distilled water, 0.5 grams CMC (Hercules 12M31XP), and 0.25 grams polyacrylamide (American Cyanamid P-250).

The slurry was extruded through a 79 mils. or 0.079 inch orifice with a Zenith gear pump into a continuous filament which was then immersed into various crosslinking or hardening solutions and subsequently onto a solid Nylon conveyor belt. The extrusion rate was about 5 feet per minute and the filament residence time in the various solutions was about 2½ minutes before being subsequently wound onto a 2½ inch diameter spool. Wire made by reducing and sintering the filament was about 44 mils or 0.044 inch in diameter, kinkable and possessed good microstructure. This experiment demonstrated the feasibility of forming continuous wire from slurry compositions according to the invention. The effects of the various hardening solutions utilized on the ductility of the final sintered wire product are tabulated in the following table.

TABLE 1

| Solution | Percent by Weight | | | Cation Percent by Weight | | | Sintered Wire |
|---|---|---|---|---|---|---|---|
| No. | $FeCl_2 . 4H_2O$ | $NiCl_2 . 6H_2O$ | $Zn(CH_3COO)_2 . 2H_2O$ | $Fe^{++}$ | $Ni^{++}$ | $Zn^{++}$ | Ductility(1) |
| 1 | 6.7 | 6.7 | 6.7 | 1.9 | 1.7 | 2.0 | Breaks at tight kink |
| 2 | 8.0 | 4.0 | 8.0 | 2.2 | 1.0 | 2.4 | " |
| 3 | 10.0 | 10.0 | 0 | 2.8 | 2.5 | 0 | " |
| 4 | 10.0 | 5.0 | 5.0 | 2.8 | 1.25 | 1.5 | Takes a tight kink |
| 5 | 5.0 | 5.0 | 10.0 | 1.4 | 1.25 | 3.0 | " |
| 6 | 5.0 | 10.0 | 5.0 | 1.4 | 2.5 | 1.5 | " |
| 7 | 20.0 | 0 | 0 | 5.6 | 0 | 0 | " |
| 8 | 0 | 20.0 | 0 | 0 | 5.0 | 0 | " |

TABLE 1-continued

| Solution No. | Percent by Weight $FeCl_2 . 4H_2O$ | $NiCl_2 . 6H_2O$ | $Zn(CH_3COO)_2 . 2H_2O$ | Cation Percent by Weight $Fe^{++}$ | $Ni^{++}$ | $Zn^{++}$ | Sintered Wire Ductility[1] |
|---|---|---|---|---|---|---|---|
| 9 | 0 | 0 | 20.0 | 0 | 0 | 6.0 | Breaks at tight kink |

[1]Reduced 15 minutes at 950 F. and sintered 10 minutes at 1900 F. in dissociated ammonia.

A study was made to determine the effects of reducing the binder content in order to reduce costs. This study centered upon the investigation of various alginates and the effects of same on viscosity of the mix. The following table provides a tabulation of the alginates considered.

TABLE 2

| Designation | Type | 1% Solution Viscosity[a] cps (centipoise) |
|---|---|---|
| Kelco-Gel Lv | Low calcium sodium alginate | 50 |
| Kelco-Gel Hv | " | 400 |
| Kelcosol | " | 1300 |
| Kelgin RL | Refined sodium alginate | 10 |
| Superloid | Refined ammonium alginate | 1500 |
| Kelmar | Refined potassium alginate | 270 |

[a]Kelco data obtained with a Brookfield LFV viscometer at 60 rpm.

The possibility of increasing the solids content of the mix to improve sintered product quality, particularly in the case of wire, was studied by making representative slurries with a Kelgin LV binder to provide indications as to the lower limits of binder contents and corresponding upper limits of solids content. The results of this study are tabulated below.

TABLE 3

| Slurry | Alginate, g/100 g oxide | Tamol 850 ml/100 g oxide | Solids, % | Viscosity cps (centipoise)[a] |
|---|---|---|---|---|
| 1 | 1.0 | 3.0 | 70 | 10,000[b] |
| 2 | 0.5 | 1.5 | 75 | 10,000[b] |
| 3 | 0.25 | 1.5 | 75 | 4,700 |
| 4 | 0.1 | 1.5 | 75 | 3,900 |
| 5 | 0.05 | 1.5 | 75 | 3,900 |
| 6 | 0.01 | 1.5 | 75 | 2,700 |
| 7 | 0.00 | 1.5 | 75 | 2,500 |
| 8 | 0.07 | 1.5 | 80 | 10,000[b] |
| 9 | 0.05 | 3.0 | 84 | 10,000[b] |

[a]Brookfield LVF viscometer at 60 rpm.
[b]Measurement was offscale for the spindle used, but the slurry was pourable and could be extruded with hand pressure.

As seen in TABLE 3 for Slurries 1–7, the viscosities of the composition slurries decreased as the alginate content decreased, with the solids content and Tamol content remaining constant. A minimum Tamol content of about 1.5 ml. per 100 grams oxide was judged to be needed in the 75% solids slurries to prevent excessive thixotropy. Slurries 8 and 9 are at relatively low binder content with increasing solids loading. As much as 84% solids could be achieved in a pourable, low viscosity slurry, but the slurry was so thixotropic and the surface dried so fast that it was judged to be too difficult to work with. About 80% solids content appeared to be both reasonable and optimum. It was observed that, above a specific solids loading for a given oxide type, the viscosities of the slurries increase asymptotically. A sheet made from a composition containing less than 0.05 grams alginate per 100 grams oxide was very weak in the green condition and did not make a ductile sintered product. An alginate content of 0.05 grams per 100 grams oxide appeared to be the approximate lower limit for sheet production with about 75% solids content.

The following four examples illustrate mix compositions according to the invention and having a wide range of viscosities.

EXAMPLE 3

568 g $Fe_2O_3$
232 g $CoO_4$
455 cc $H_2O$
16 cc Tamol 850
3.3 g CMC (Hercules 9H4)

Viscosity measured with a Brookfield LVF viscometer at 20 rpm—3400 cps.

EXAMPLE 4

600 g $Fe_2O_3$
234 cc $H_2O$
18 cc Tamol 850
2.34 g ammonium pentaborate
3.0 g CMHP Viscosity measured with a Brookfield RVF viscometer at 10 rpm—100,000 cps.

EXAMPLE 5

600 g $Fe_2O_3$
234 cc $H_2O$
18 cc Tamol 850
2.34 g ammonium pentaborate
2.4 g CMHP Viscosity measured with a Brookfield RVF viscometer at 10 rpm—47,500 cps.

EXAMPLE 6

22,700 g $Fe_2O_3$
7,567 cc $H_2O$
399 cc Tamol 850
39.8 g ammonium pentaborate
199 g CMHP Viscosity measured with a Brookfield RVF viscometer at 2 rpm—720,000 cps.

It has been ascertained that the viscosity range within which the composition according to the invention maintains its "pourable" viscoelastic characteristic is approximately 1,000 to 1,000,000 cps (centipoise).

The binder agent becomes the critical ingredient in producing unexpected results in the form of a very extensible composition mix at low binder levels. Though many binder type materials are extensible by themselves or when filled with relatively small amounts of solid particles, it has been ascertained that guar gums, when properly treated, impart extensibility to a highly filled system at binder-to-oxide ratios of about 1.5 to 100 and less. Guar gums form reversible crosslinked gels when treated with borate, dichromate, antimonate and other ions. Gels formed with borate ion can be converted to a sol by adjusting the pH. This reaction is completely reversible and may be repeated as often as desired. Moreover, a highly filled system with guar gum binder can be made extensible by controlling the pH in the range where the sol is only partially converted to the gel. Experimentation has demonstrated that the pH range for an extensible mix is about 6.3 to 7.3. The pH if preferably controlled to within approximately ±0.025 in order to maintain consistent mix characteristics.

Some examples of composition mixes according to the invention which possess an extensible characteristic for forming filamentary shapes are as follows:

EXAMPLE 7

1500 gm $Fe_2O_3$
500 cc $H_2O$
30 cc Tamol 850
4.5 gm ammonium pentaborate
22.5 gm guar gum
pH of mix adjusted to 6.9 with HCl

EXAMPLE 8

100 gm $Fe_2O_3$
23.2 cc $H_2O$
2.0 cc Tamol 850
0.1 gm ammonium pentaborate
1.0 gm guar gum
with the pH adjusted to 6.7 with HCl

EXAMPLE 9

22,700 gm $Fe_2O_3$
7,168 cc $H_2O$
454 cc Tamol 850
68.1 gm ammonium pentaborate
272 gm guar gum
with the pH adjusted to 6.9 with HCl While the invention has been described and exemplified with reference to specific preferred operating parameters, those skilled in the art will necessarily appreciate that various modifications, changes, additions, omissions and substitutions may be made without departing from the spirit of the invention or scope of the following claims.

What is claimed is:

1. A viscoelastic composition for forming shaped bodies comprising at least approximately 50% by weight of a reducible metal compound in particulate form, a binder, a dispersant, and water.

2. The composition of claim 1 wherein the composition comprises up to approximately 15% by weight of binder and up to approximately 1.5% by weight of dispersant.

3. The composition of claim 2 wherein the composition comprises approximately 0.5–5% by weight of binder and approximately 0.1–1.5% by weight of dispersant.

4. The composition of claim 1 wherein the binder is a member selected from the group consisting of carboxymethylcellulose, guar gums and derivatives thereof, alginates, and mixtures thereof.

5. The composition of claim 1 wherein the dispersant comprises a sodium salt of a polyelectrolyte.

6. The composition of claim 1 wherein the composition comprises approximately 60–85% of reducible metal compound.

7. The composition of claim 1 wherein the metal compound is a member selected from the group consisting of the oxides of Fe, Co, Ni, Cu, Cr, Mn, Mo and W, the insoluble chlorides of Cu, Mo, W and Cr, the sulfides of Cu, Fe, Co, Ni and Mo, and mixtures thereof.

8. The composition of claim 1 wherein the metal compound is a member selected from the group consisting of the oxides of Fe, Ni, Co, Cr and mixtures thereof.

9. The composition of claim 1 wherein the metal compound is an oxide of iron.

10. The composition of claim 1 wherein the mean diameter of the metal compound particles does not exceed approximately 6 microns.

11. The composition of claim 1 wherein at least approximately 25% of the metal compound particles have a mean diameter not exceeding approximately 2.5 microns.

12. The composition of claim 1 wherein the composition further includes a crosslinking agent.

13. The composition of claim 12 wherein the crosslinking agent is ammonium pentaborate.

14. The composition of claim 1 wherein the viscosity of the composition is approximately 1,000 to 1,000,000 centipoise.

15. A method of making dense metal articles comprising the steps of:

(a) forming a shaped body from a viscoelastic composition comprising approximately 50% by weight of a reducible metal compound in particulate form, a binder, a dispersant, and water;

(b) exposing the shaped body to a reducing environment to reduce the metal compound to free metal particles; and (c) subjecting the shaped body to a temperature sufficient to effect sintering of the free metal particles to produce a dense metal article.

16. The method of claim 15 wherein the composition comprises up to approximately 15% by weight of binder and up to approximately 1.5% by weight of dispersant.

17. The method of claim 15 wherein the composition comprises approximately 0.5–1.5% by weight of binder and approximately 0.1–1.5% by weight of dispersant.

18. The method of claim 15 wherein the binder is a member selected from the group consisting of carboxymethylcellulose, guar gums and derivatives thereof, alginates, and mixtures thereof.

19. The method of claim 15 wherein the composition comprises approximately 60–85% of reducible metal compound.

20. The method of claim 15 wherein the metal compound is a member selected from the group consisting of the oxides of Fe, Co, Ni, Cu, Cr, Mn, Mo and W, the insoluble chlorides of Cu, Mo, W and Cr, the sulfides of Cu, Fe, Co, Ni and Mo, and mixtures thereof.

21. The method of claim 15 wherein the metal compound is a member selected from the group consisting of the oxides of Fe, Ni, Co, Cr and mixtures thereof.

22. The method of claim 15 wherein the metal compound is an oxide of iron.

23. The method of claim 15 wherein the binder is capable of undergoing crosslinking and the composition further includes a crosslinking agent.

24. The method of claim 23 further including the step of subjecting the shaped body to a crosslinking environment prior to reducing the metal compound.

25. The method of claim 24 wherein the crosslinking environment comprises a liquid bath containing a member selected from the group consisting of iron chlorides, nickel chloride, zinc acetate and mixtures thereof.

26. The method of claim 15 wherein the viscosity of the composition is approximately 1,000 to 1,000,000 centipoise.

27. The method of claim 15 wherein the binder is capable of undergoing crosslinking and further including the step of subjecting the shaped body to a crosslinking environment prior to reducing the metal compound.

28. The method of claim 27 wherein the crosslinking environment comprises a liquid bath containing a member selected from the group consisting of iron chlorides, nickel chloride, zinc acetate and mixtures thereof.

29. A viscoelastic composition for forming shaped bodies and having a viscosity of from about 1,000 to 1,000,000 centipoise comprising:

(a) approximately 60–85% by weight of a reducible metal compound in particulate form selected from the group consisting of the oxides of Fe, Co, Ni, Cu, Cr, Mn, Mo and W, the insoluble chlorides of Cu, Mo, W and Cr, the sulfides of Cu, Fe, Co, Ni and Mo, and mixtures thereof;

(b) approximately 0.5–5% by weight of a binder selected from the group consisting of carboxymethylcellulose, guar gums and derivatives thereof, alginates, and mixtures thereof;

(c) approximately 0.1–1.5% by weight of a sodium salt of a polyelectrolyte;

(d) and the balance water; and (e) wherein at least approximately 25% of the metal compound particles have a mean diameter not exceeding approximately 2.5 microns.

30. A method of making dense metal articles comprising the steps of:

(a) forming a shaped body from a viscoelastic composition having a viscosity of from about 1,000 to 1,000,000 centipoise and comprising:

1. approximately 60–85% by weight of a reducible metal compound in particulate form selected from the group consisting of the oxides of Fe, Co, Ni, Cu, Cr, Mn, Mo and W, the insoluble chlorides of Cu, Mo, W and Cr, the sulfides of Cu, Fe, Co, Ni and Mo, and mixtures thereof;
2. approximately 0.5–5% by weight of a binder selected from the group consisting of carboxymethylcellulose, guar gums and derivatives thereof, alginates, and mixtures thereof;
3. approximately 0.1–1.5% by weight of a sodium salt of a polyelectrolyte;
4. and the balance water; and (b) exposing the shaped body to a reducing environment to reduce the metal compound to free particles; and (c) subjecting the shaped body to a temperature sufficient to effect sintering of the free metal particles to produce a dense metal article.

* * * * *